United States Patent [19]

Firster

[11] 3,984,100

[45] Oct. 5, 1976

[54] EXERCISER APPARATUS FOR THE HUMAN EXTREMITIES

[76] Inventor: Lawrence D. Firster, HHB Discom, 101st Airborne Division, Ft. Campbell, Ky. 42223

[22] Filed: Mar. 3, 1975

[21] Appl. No.: 554,980

[52] U.S. Cl. ..... 272/96; 272/146

[51] Int. Cl.[2] ..... A63B 23/04

[58] Field of Search ..... 272/57 R, 57 D, 60 R, 272/84, 57 A, 33 A, 96, 146; 128/25 B

[56] References Cited

UNITED STATES PATENTS

| | | | |
|---|---|---|---|
| 1,509,793 | 9/1924 | Thompson | 272/57 D |
| 2,803,461 | 8/1957 | Coplin | 272/57 D |
| 3,020,046 | 2/1962 | Hotas | 272/57 D |
| 3,024,021 | 3/1962 | Coplin et al. | 272/57 D |

FOREIGN PATENTS OR APPLICATIONS

| | | | |
|---|---|---|---|
| 445,349 | 1968 | Switzerland | 272/57 D |

*Primary Examiner*—Richard C. Pinkham
*Assistant Examiner*—Harry G. Strappello
*Attorney, Agent, or Firm*—C. Walter Mortenson

[57] ABSTRACT

There is provided by this invention an apparatus that can be placed on a flat surface and used conveniently for exercising the human foot under a variety of conditions. Beneath a support for the foot is positioned an element that affords pivotable relationship between the support and the flat surface, and fixed to the support there is at least one means for receiving an attachment for varying the conditions, such as the weight and the angle of use during the exercising. In other words, the attachments subject the foot during the exercising to such conditions as the amount of force or the amount of tilting that the foot must apply in order to activate the exercising device.

The support for the foot can be in the form of a flat plate, generally made of wood or a plastic, underneath of which is positioned a rounded or ball-like member to allow for the said pivotable relationship at different positions. On the plate are receptacles, generally internally threaded which afford means for placing the said attachments, such as weights or levers, on the plate. The attachments may also be of such size and shape that effect tilting of the foot, and different attachments may be simultaneously attached to the apparatus.

4 Claims, 12 Drawing Figures

Fig.5.
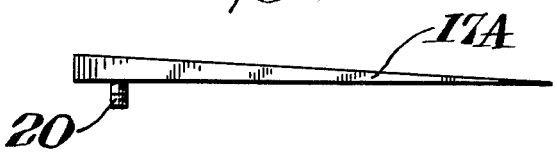
Fig.7.
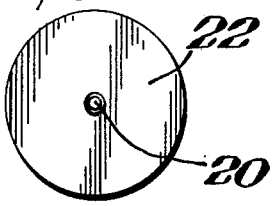
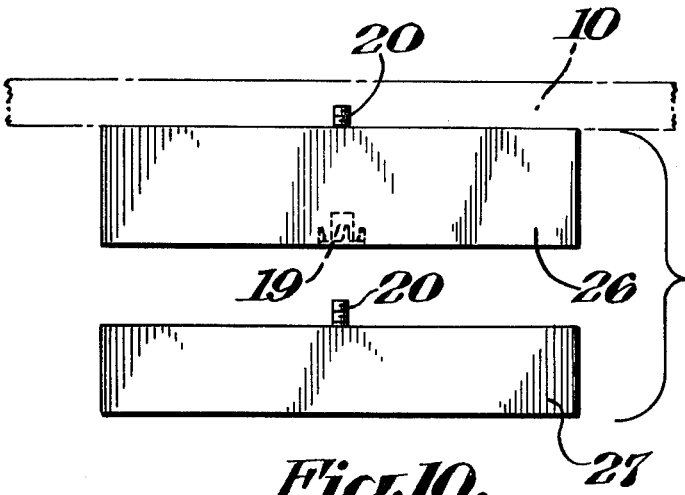
Fig.6.
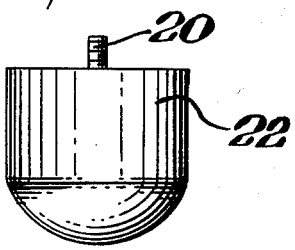
Fig.9.
Fig.10.
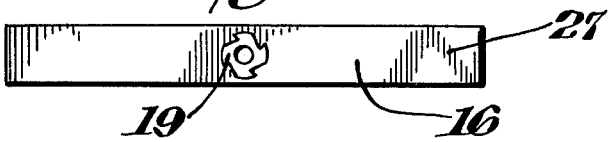
Fig.12.
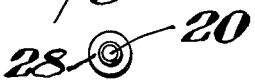
Fig.8
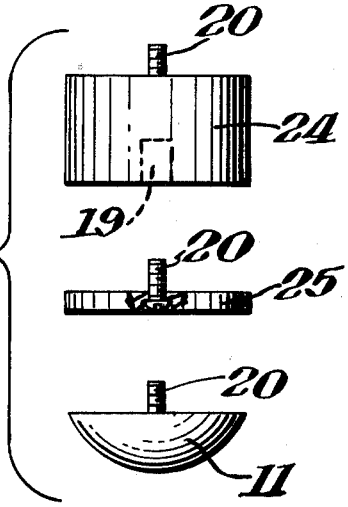
Fig.11.
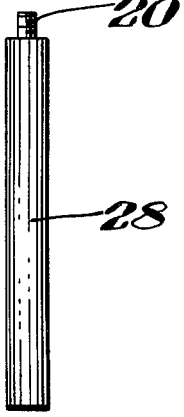

EXERCISER APPARATUS FOR THE HUMAN EXTREMITIES

BACKGROUND OF THE INVENTION

A number of devices are available that afford the movement of the human foot under different conditions. Such devices include trays which are rotatably and/or pivotably mounted. However, heretofore there has not been available a device that allows the user to subject the foot to be exercised to a series or a variety of exercising conditions. In other words, the devices heretofore available have been limited to one or very few motions and/or tensions.

Accordingly, it is an object of this invention to provide an exerciser that is readily assembled and affords a variety of these conditions.

Another aim is the provision of an apparatus that has a means for attaching to it at least one other means for varying the motions involved in activating the device.

A still further provision of this invention is an adjustable apparatus that can be used on a flat surface for affording the exercising of the human foot under a variety of conditions such as weight and angles.

These and other objectives will appear hereinafter with reference to the description below and to the drawings described below, all of which is given for illustrative purposes only and is not limitative and the drawings which are described below.

BRIEF DESCRIPTION OF THE DRAWINGS

FIG. 5 is a side view of an alternate attachment similar to that shown in FIG. 3;

FIG. 6 is a side elevational view of an additional attachment;

FIG. 7 is a top plan view of the device shown in FIG. 6;

FIG. 8 shows a series of other attachments and how they can be placed in cooperative positions or attached in use with each other;

FIG. 9 similarly shows additional attachments;

FIG. 10 is a bottom plan view of the attaching element shown in FIG. 9;

FIG. 11 is a side elevational view of still another attachment; and

FIG. 12 is a top plan view of the device of FIG. 11.

DESCRIPTION OF THE DRAWINGS AND EMBODIMENTS

Figure 2:
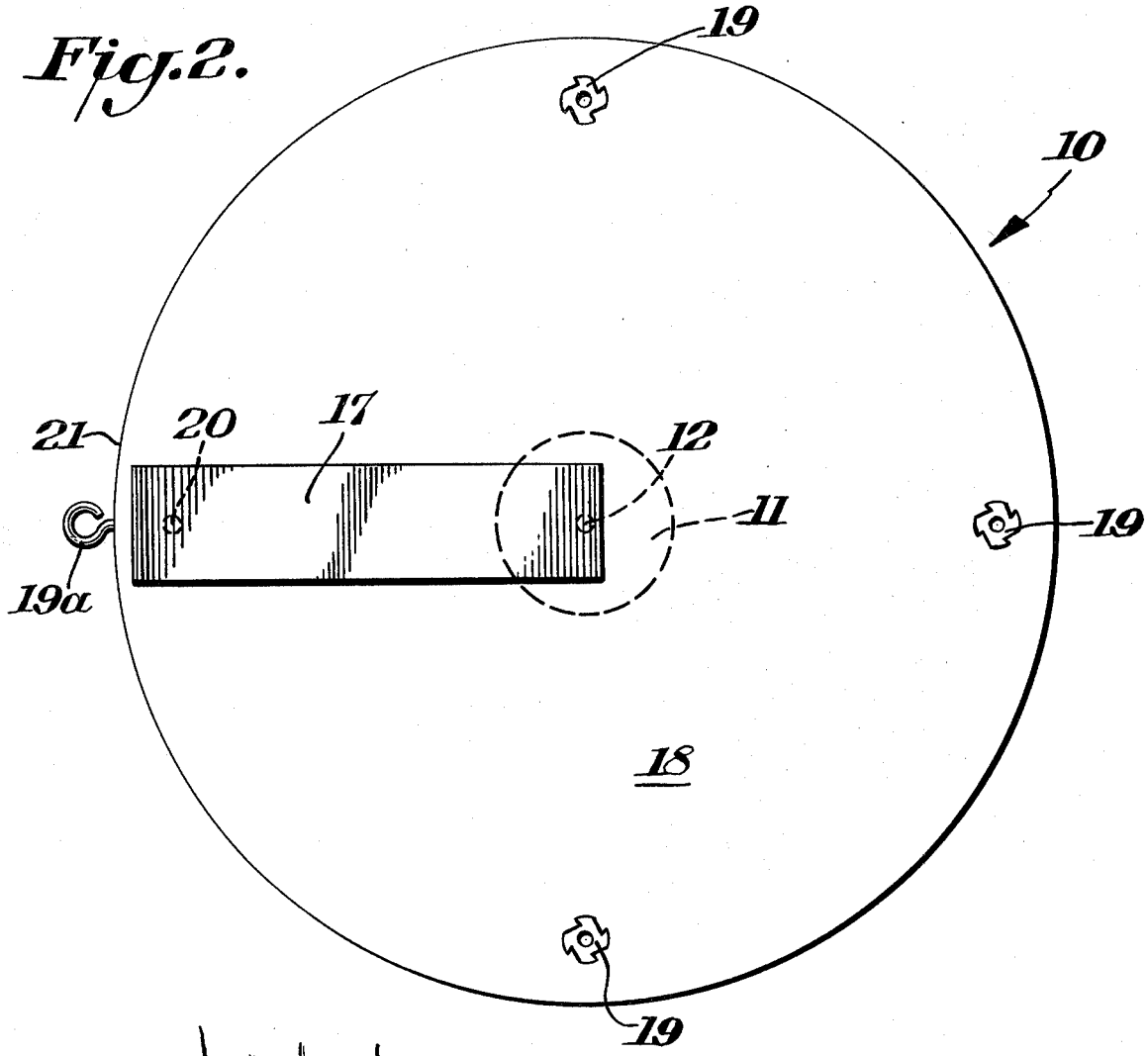
FIG. 2 is a top plan view of the device shown in FIG. 1 with the human foot removed, but with an attachment in position.
Figure 1:
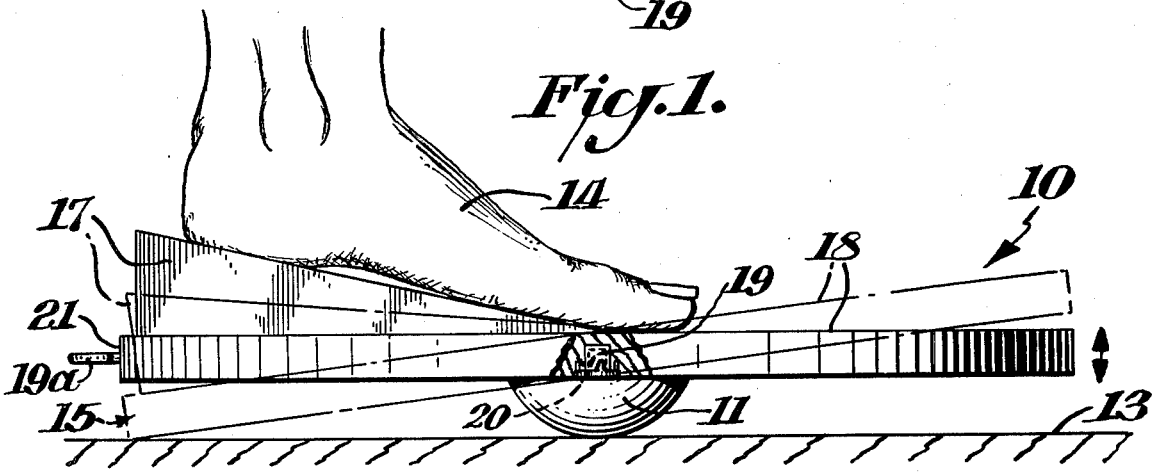
FIG. 1 is a side elevational view of the device of this invention shown on a flat surface with an attachment in operative position and showing a human foot activating the device.

As shown in FIG. 1 a platform 10 has attached to it rounded member 11 which is convex or ball-like and is attached as shown in the broken section via a threaded stud arrangement at 12 (FIG. 2). As shown in operative position, pivotable member 11 is in contact with the flat surface 13 and the human foot 14 can rock the device upwardly and downwardly as shown in the phantom position 15. Also shown in FIG. 1 is attachment 17 which rests on the top surface 18 of tray 10 and is a wedge-like element that places foot 14 at an angle to surface 18.

Figure 3:
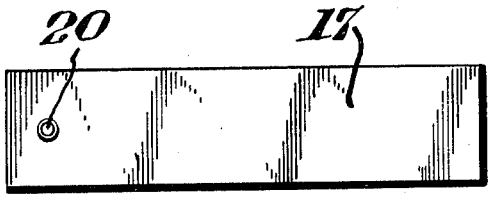
FIG. 3 is a bottom plan view of the attachment shown in FIG. 1.

As can be seen in FIG. 2, tray element 10 is generally a disc or circular tray, although any shape can be used. It affords a surface substantially greater than the bottom area of the largest human foot, the total area being about 2 to about 6 times the area of the foot to afford considerable leverage or forces to be overcome by the exerciser. Contained in the top surface 18 of platform 10 are a plurality of receptacles 19 which allow the fixation of removable attachments such as attachment 17. The underneath surface of tray 10 is similarly provided with receptacles 19. As shown in FIGS. 3 and 5, attachments 17 and 17A have threaded studs 20 which are used with an internally-threaded receptacle 19 in fixing attachment 17 or 17A to the top surface 18 of tray 10. Tray 10 may also have in its sidewall 21 an element 19*a*, being a hook, allowing one to hang up tray 10 conveniently on a wall. Such sidewall receptacles can receive other attachments, such as weights. The receptacle 19 shown in bottomwall 16 in FIG. 10 can, of course, receive any of the attachments of this invention allowing variations in weights and the like. By use of receptacles 19 and the attachments, one can subject the foot being exercised to a large variety of vectors of force.

Figure 4:
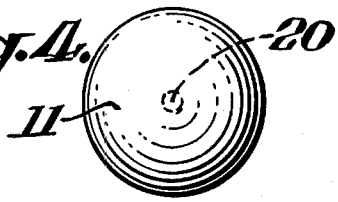
FIG. 4 is a bottom plan view of the pivotable member under the device of this invention.

The rounded surface of element 11 is shown in FIG. 4 and it is to be appreciated that the removability of pivoting member 11 allows one to replace it with a device more difficult to effect pivoting or affording pivoting at different angles. For example, attachment 22, shown in FIG. 6, may be placed on the bottom of tray 10. This varies the height of tray 10 from the flat surface 13 and changes the angle and affects the forces needed in pivoting the apparatus. Attachment 22 may be unitary or it may be made in segments as shown in FIG. 8 wherein the bottommost rounded element 11 is separable from the top section 24 by intermediate section 25, each of the sections 24 and 25 being provided with stud elements 20 and receiving elements 19.

Further, as shown, a rounded member need not be used, for a flat surfaced element as 26, shown in FIG. 9, can be attached to tray 10 and the flat surface of attachment 26 can be placed on flat surface 13, thus severely changing the angles and forces involved in pivoting the apparatus. Again, such an element as 26 can be adapted to receive other attachments such as element 27 shown in FIG. 9. If one desires to change the height of the tray 10 substantially elongated attachment 24, shown in FIGS. 11 and 12 may be used in place of element 11. The platform 10 may be placed close to or far from the floor 13, distances of about 2 to about 12 inches usually being employed.

The attachment means comprising receptacles 19 and studs 20 generally are metallic elements though they can be made from polymeric materials such as nylon, polyformaldehydes or phenolic materials. Other types of attaching means can be used, of course, and of such the simple magnetic attachments are conveniently employed. The platform 10 and the various attachments can be made out of the same material or they may be different. Materials which can be used include wood, the above-named polymeric materials, among many others, metals such as aluminum, though nonmetallic substances are generally preferred. In some instances the platform and/or attachments are made to carry weights usually made of lead. Generally, the platform and its attachments are made of the same material, preferably wood.

As described above, a large variety of attachments may be used in a large number of positions. The user thus has a device which allows him to exercise the foot and leg under a tremendous number of conditions. He can start with an arrangement that is relatively easily activated and as the foot or leg builds up in strength and muscle tenor he can progress successively to more and more difficult exercises.

Still further, he can use the apparatus of this invention while seated or standing with attendant changes or effects of the exercising on the calves, thighs, spine, and abdominal muscles. In the case of the physical therapy of an injured person, the progress of the changes in utility of the injured part can be followed closely, thus affording exercises carefully graduated in difficulty to assure healthy progress and avoiding overdoing tasks. The exerciser advantageously visually sees the progress as attachments are changed. Further, the apparatus affords movements in many directions — forwards, upwards, downwards, circular, sidewards, and the like. Movements from easily pivotable to virtually unpivotable are available under conditions that are controllable or regulated so that causing injury or impairment may be virtually avoided.

While the invention has been disclosed herein in connection with certain embodiments and certain structural and procedural details, it is clear that changes, modifications, or equivalents can be used by those skilled in the art; accordingly, such changes within the principles of the invention are intended to be included within the scope of the claims below.

I claim:

1. Adjustable apparatus for placement on a flat surface, such as a floor, to afford exercising of the human foot under a variety of conditions of weight and angles through the use of removable attachments to alter said weight or to change said angles, said apparatus comprising a support for said foot, said support being substantially larger than a human foot of average size and having securing means thereon for removably securing said attachments directly on the bottom, the top, and the side wall of said support, as desired, there being a plurality of differently-shaped foot inclining attachments and a plurality of differently configured supporting attachments, said attachments having means thereon for selective attachment to and removal from said support and for selective attachment to and removal from other attachments thereby affording a plurality of different configurations; at least one said supporting attachment being removably secured to said support beneath it thereby affording pivotable and rotational relationship, as desired, between said support and said surface; and said support securing means being a plurality of receptacles fixed to said support for securing one or more of said attachments to said apparatus, thereby allowing adjustments by combination of attachments to effect said alteration of weights and said changing of angles, as desired.

2. Apparatus in accordance with claim 1 in which said supporting attachment beneath said support is a rounded element affording a ball-like contact with said flat surface.

3. Apparatus in accordance with claim 1 in which said supporting attachment beneath said support has a height that places said support from about two inches to about twelve inches from said flat surface when said supporting attachment beneath said support is in contact with said flat surface.

4. Apparatus in accordance with claim 1 which includes an attachment that is a hook.

* * * * *